US009728885B2

(12) United States Patent
Yokoyama

(10) Patent No.: US 9,728,885 B2
(45) Date of Patent: Aug. 8, 2017

(54) CONNECTOR

(71) Applicant: JAPAN AVIATION ELECTRONICS INDUSTRY, LIMITED, Shibuya-ku, Tokyo (JP)

(72) Inventor: Yohei Yokoyama, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/309,970

(22) PCT Filed: May 15, 2015

(86) PCT No.: PCT/JP2015/064093
§ 371 (c)(1),
(2) Date: Nov. 9, 2016

(87) PCT Pub. No.: WO2015/186495
PCT Pub. Date: Dec. 10, 2015

(65) Prior Publication Data

US 2017/0149164 A1 May 25, 2017

(30) Foreign Application Priority Data

Jun. 3, 2014 (JP) ..... 2014-115220

(51) Int. Cl.
*H01R 13/502* (2006.01)
*H01R 24/60* (2011.01)
*H01R 107/00* (2006.01)

(52) U.S. Cl.
CPC ..... *H01R 13/502* (2013.01); *H01R 24/60* (2013.01); *H01R 2107/00* (2013.01)

(58) Field of Classification Search
CPC ..... H01R 24/60
See application file for complete search history.

(56) References Cited

U.S. PATENT DOCUMENTS 6,361,366 B1 3/2002 Shuey et al.
7,001,208 B2 2/2006 Huang
(Continued)

FOREIGN PATENT DOCUMENTS

JP 02216776 A 8/1990
JP 08028255 B2 3/1996
(Continued)

OTHER PUBLICATIONS

International Search Report (ISR) and Written Opinion dated Aug. 11, 2015 issued in International Application No. PCT/JP2015/064093.
(Continued)

*Primary Examiner* — Ross Gushi
(74) *Attorney, Agent, or Firm* — Holtz, Holtz & Volek PC

(57) ABSTRACT

A connector is mateable with a mating connector along a front-rear direction. The connector includes a contact member and a ground member. The contact member includes a plurality of contacts and an arrangement member. The arrangement member holds and arranges the contacts in a pitch direction perpendicular to the front-rear direction. The arrangement member is provided with two press-fit protrusions and an island-like protrusion. Each of the press-fit protrusions protrudes in a protruding direction perpendicular to both the front-rear direction and the pitch direction. The island-like protrusion protrudes in the protruding direction while extending long in a predetermined direction perpendicular to the protruding direction. The ground member has a plate-like main portion. The main portion of the ground member is formed with two holes and a protrusion accommodation portion. The press-fit protrusions are press-fit into the holes, respectively. The island-like protrusion is accommodated in the protrusion accommodation portion.

7 Claims, 9 Drawing Sheets

(56) References Cited

U.S. PATENT DOCUMENTS 9,214,767 B1 * 12/2015 Yu ..... H01R 13/6585
9,281,626 B2 * 3/2016 Lin ..... H01R 13/6581
9,350,126 B2 * 5/2016 Little ..... H01R 24/60
9,350,128 B1 * 5/2016 Chen ..... H01R 13/6582
9,356,400 B2 * 5/2016 Little ..... H01R 4/023
9,362,680 B2 * 6/2016 Kao ..... H01R 13/6583
9,362,695 B2 * 6/2016 Yu ..... H01R 24/70
9,373,916 B2 * 6/2016 Liu ..... H01R 13/6581
9,379,499 B2 * 6/2016 Miyoshi ..... H01R 24/60
9,385,438 B2 * 7/2016 Wu ..... H01R 4/023
9,397,433 B2 * 7/2016 Kao ..... H01R 13/658
9,413,123 B2 * 8/2016 Kao ..... H01R 13/2442
9,425,565 B1 * 8/2016 Chien ..... H01R 12/707
9,431,781 B2 * 8/2016 Kuang ..... H01R 24/60
9,444,204 B2 * 9/2016 Yen ..... H01R 24/78
9,450,337 B2 * 9/2016 Kao ..... H01R 13/6461
9,450,341 B2 * 9/2016 Kao ..... H01R 13/6585
9,450,342 B2 * 9/2016 Wu ..... H01R 13/6593
9,455,535 B1 * 9/2016 Chiang ..... H01R 13/6585
9,461,424 B2 * 10/2016 Kao ..... H01R 24/60
9,461,425 B2 * 10/2016 Tamaki ..... H01R 13/508
9,466,918 B2 * 10/2016 Chen ..... H01R 13/56
9,472,905 B2 * 10/2016 Peng ..... H01R 13/6658
9,472,907 B2 * 10/2016 Kao ..... H01R 13/6595
9,478,878 B2 * 10/2016 Wu ..... H01R 9/0515
9,478,916 B2 * 10/2016 Kao ..... H01R 13/6593
9,478,923 B2 * 10/2016 Kao ..... H01R 24/60
9,478,925 B2 * 10/2016 Wu ..... H01R 24/60
9,484,676 B2 * 11/2016 Chuang ..... H01R 13/6581
9,484,681 B2 * 11/2016 Little ..... H01R 13/6597
9,490,549 B2 * 11/2016 Little ..... H01R 4/023
9,490,579 B2 * 11/2016 Little ..... H01R 13/642
9,502,827 B2 * 11/2016 Chen ..... H01R 13/6581
9,502,837 B2 * 11/2016 Kao ..... H01R 24/60
9,515,436 B2 * 12/2016 Kao ..... H01R 24/60
9,515,439 B2 * 12/2016 Ng ..... H01R 24/70
9,520,673 B2 * 12/2016 Xing ..... H01R 13/5845
9,520,677 B2 * 12/2016 Cheng ..... H01R 13/631
9,531,144 B2 * 12/2016 Tsai ..... H01R 13/658
9,538,652 B2 * 1/2017 Kao ..... H05K 1/111
9,553,409 B2 * 1/2017 Deng ..... H01R 13/6581
9,564,715 B1 * 2/2017 Lin ..... H01R 13/6581
9,577,360 B2 * 2/2017 Kao ..... H01R 12/722
9,577,385 B1 * 2/2017 Lin ..... H01R 13/6585
9,583,889 B2 * 2/2017 Wu ..... H01R 13/6593
9,583,900 B2 * 2/2017 Cheng ..... H01R 4/023
9,590,360 B2 * 3/2017 Chuang ..... H01R 13/6581
9,595,796 B2 * 3/2017 Yen ..... H01R 13/6581
9,601,883 B1 * 3/2017 Chung ..... H01R 24/60
2001/0041475 A1 11/2001 Tsuji et al.
2005/0042896 A1 2/2005 Huang
2015/0340815 A1 * 11/2015 Gao ..... H01R 13/6581 439/607.01
2016/0013581 A1 * 1/2016 Wu ..... H01R 13/5845 439/452
2016/0020537 A1 * 1/2016 Ju ..... H01R 24/78 439/83
2016/0020569 A1 * 1/2016 Ju ..... H01R 24/78 439/607.01
2016/0043512 A1 * 2/2016 Kao ..... H01R 12/57 439/620.22
2016/0079689 A1 * 3/2016 Wu ..... B23K 1/0016 439/581
2016/0079711 A1 * 3/2016 Chung ..... H01R 24/60 439/607.55
2016/0099524 A1 * 4/2016 Hack ..... H01R 13/6583 439/607.55
2016/0134056 A1 * 5/2016 Chen ..... H01R 13/642 439/217
2016/0141816 A1 * 5/2016 Chiang ..... H01R 13/658 439/676
2016/0141817 A1 * 5/2016 Wu ..... H01R 24/60 439/676
2016/0149348 A1 * 5/2016 Kao ..... H01R 13/6585 439/607.05
2016/0156144 A1 * 6/2016 Kao ..... H01R 24/60 439/676
2016/0172791 A1 * 6/2016 Fan ..... H01R 13/6585 439/607.05
2016/0181734 A1 * 6/2016 Kao ..... H01R 13/6585 439/607.05
2016/0204562 A1 * 7/2016 Chen ..... H01R 43/16 29/428
2016/0226204 A1 * 8/2016 Chen ..... H01R 24/60
2016/0233617 A1 * 8/2016 Yen ..... H01R 13/6583
2016/0268741 A1 * 9/2016 Tsai ..... H01R 13/6585
2016/0268744 A1 * 9/2016 Little ..... H01R 24/60
2016/0268746 A1 * 9/2016 Tsai ..... H01R 12/7052
2016/0294101 A1 * 10/2016 Kao ..... H01R 13/502
2016/0322756 A1 * 11/2016 Tsai ..... H01R 13/6581
2016/0352047 A1 * 12/2016 Xing ..... H01R 13/64
2016/0359242 A1 * 12/2016 Tsai ..... H01R 4/2404
2016/0365673 A1 * 12/2016 Liang ..... H01R 12/57
2016/0380387 A1 * 12/2016 Wu ..... H01R 13/6581 439/95
2017/0033512 A1 * 2/2017 Chen ..... H01R 12/778
2017/0033520 A1 * 2/2017 Cheng ..... H01R 24/60
2017/0054256 A1 * 2/2017 Yokoyama ..... H01R 13/648
2017/0062991 A1 * 3/2017 Lee ..... H01R 24/28
2017/0070009 A1 * 3/2017 Chen ..... H01R 13/6585
2017/0070015 A1 * 3/2017 Chen ..... H01R 24/64
2017/0085039 A1 * 3/2017 Yokoyama ..... H01R 13/648
2017/0093062 A1 * 3/2017 Yokoyama ..... H01R 12/7047
2017/0093076 A1 * 3/2017 Yokoyama ..... H01R 13/502
2017/0093091 A1 * 3/2017 Cheng ..... H01R 13/6471

FOREIGN PATENT DOCUMENTS

JP 3324995 B2 9/2002
JP 2003249775 A 9/2003
JP 3703551 B2 10/2005
JP 2005327701 A 11/2005
JP 4219088 B2 2/2009
TW M250341 U 11/2004

OTHER PUBLICATIONS

Taiwanese Office Action dated Apr. 12, 2017 (and English translation thereof) issued in counterpart Taiwanese Application No. 104115839.

* cited by examiner

CONNECTOR

TECHNICAL FIELD

This invention relates to a connector comprising a ground member having a plate-like portion which is insulated from the contact while being arranged in the vicinity of the contact.

BACKGROUND ART

As shown in FIG. 16, a connector 900 of Patent Document 1 comprises two contact members 910 and a ground member 920. Each of the contact members 910 comprises a plurality of contacts 930 and an arrangement member 940. The arrangement member 940 arranges the contacts 930 and holds the contacts 930. One of the arrangement members 940 is formed with protrusions 950. A remaining one of the arrangement members 940 is formed with recesses (not shown) which correspond to the protrusions 950, respectively. The ground member 920 has a plate-like main portion 960. The main portion 960 is formed with holes 970 which correspond to the protrusions 950, respectively. The protrusions 950 are mated with the recesses through the holes 970, respectively, so that the main portion 960 of the ground member 920 is sandwiched between the arrangement members 940.

PRIOR ART DOCUMENTS

Patent Document(s)

Patent Document 1: JP A 2005-327701

SUMMARY OF INVENTION

Technical Problem

Since each of the arrangement members 940 and the ground member 920 of Patent Document 1 has variations in size and shape, the hole 970 may be larger than the corresponding recess 950. Accordingly, the connector 900 of Patent Document 1 has a drawback that the ground member 920 might be unstable.

Solution to Problem

It is therefore an object of the present invention to provide a connector which enables that, even if each of an arrangement member and a ground member has variations in size and shape, the ground member is fixed to the arrangement member without any play so that positionings of the ground member and a contact are appropriately carried out.

An aspect of the present invention provides a connector mateable with a mating connector along a front-rear direction. The connector comprises a contact member and a ground member. The contact member comprises a plurality of contacts and an arrangement member. The arrangement member arranges the contacts in a pitch direction perpendicular to the front-rear direction and holds the contacts. The arrangement member is provided with two press-fit protrusions and an island-like protrusion. Each of the press-fit protrusions protrudes in a protruding direction perpendicular to both the front-rear direction and the pitch direction. The island-like protrusion protrudes in the protruding direction and extends long in a predetermined direction perpendicular to the protruding direction. The island-like protrusion has a first size in the predetermine direction. Each of the press-fit protrusions has a second size in the predetermined direction. The first size is larger than the second size. The ground member has a plate-like main portion. The main portion of the ground member is formed with two holes and a protrusion accommodation portion. The press-fit protrusions are press-fit into the holes, respectively, while the island-like protrusion is accommodated in the protrusion accommodation portion.

Advantageous Effects of Invention

The press-fit protrusions of the arrangement member according to the present invention are press-fit into the holes, respectively, which are formed on the main portion of the ground member. Accordingly, even if each of the arrangement member and the ground member has variations in size and shape, the ground member can be securely fixed to the arrangement member without any play.

The press-fit protrusion might be partially shaved off when the press-fit protrusion is press-fit into the hole. Thus, in a case where the arrangement member is not provided with the island-like protrusion, a rotational deviation might occur in a positional relation between the ground member and the arrangement member in a plane perpendicular to the protruding direction in which the press-fit protrusion protrudes. In contrast, since the arrangement member according the present invention is provided with the island-like protrusion, the aforementioned rotational deviation can be prevented from occurring therein.

An appreciation of the objectives of the present invention and a more complete understanding of its structure may be had by studying the following description of the preferred embodiment and by referring to the accompanying drawings.

DESCRIPTION OF EMBODIMENTS

Figure 1:
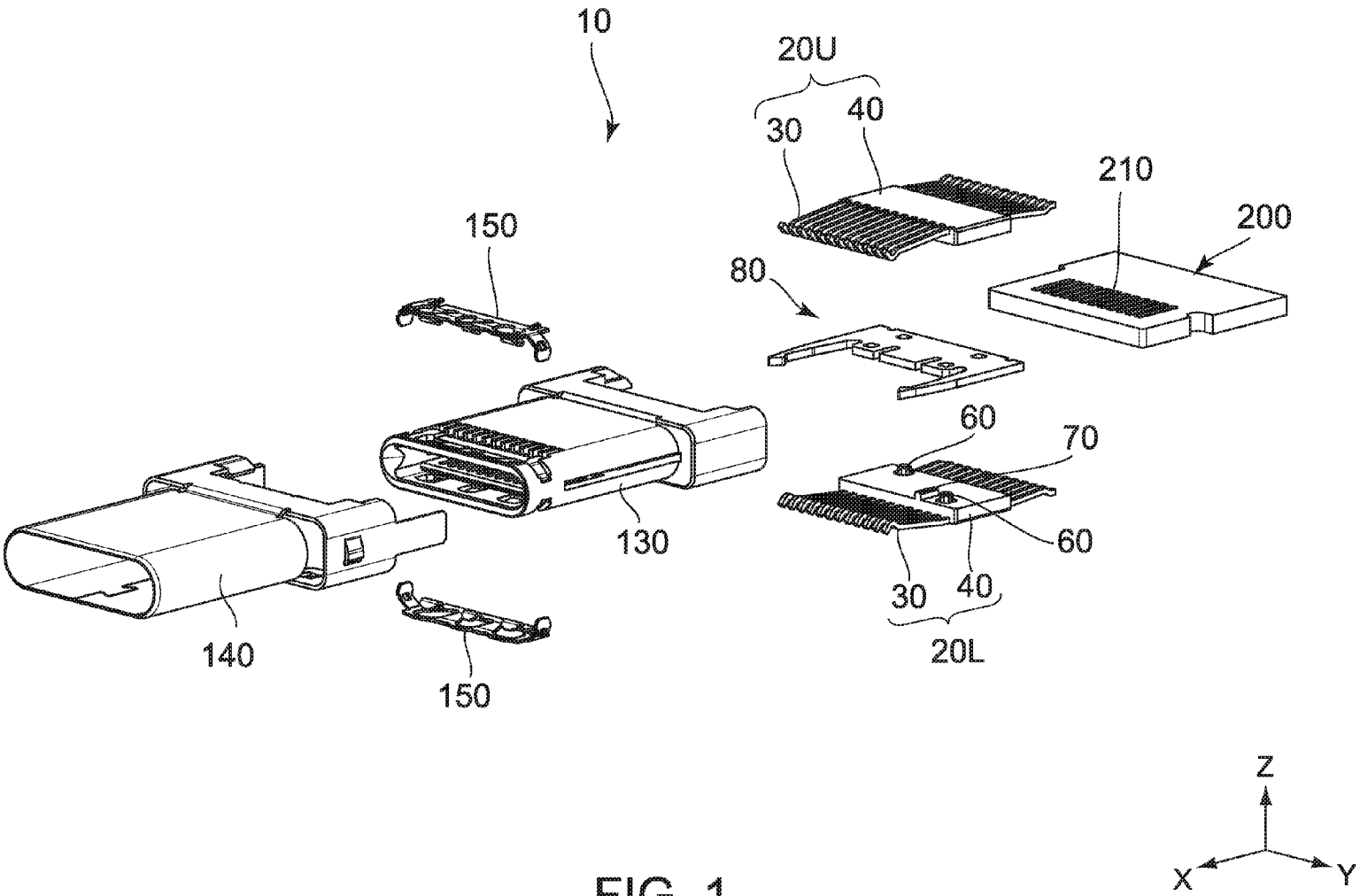
FIG. 1 is an exploded, perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Figure 2:
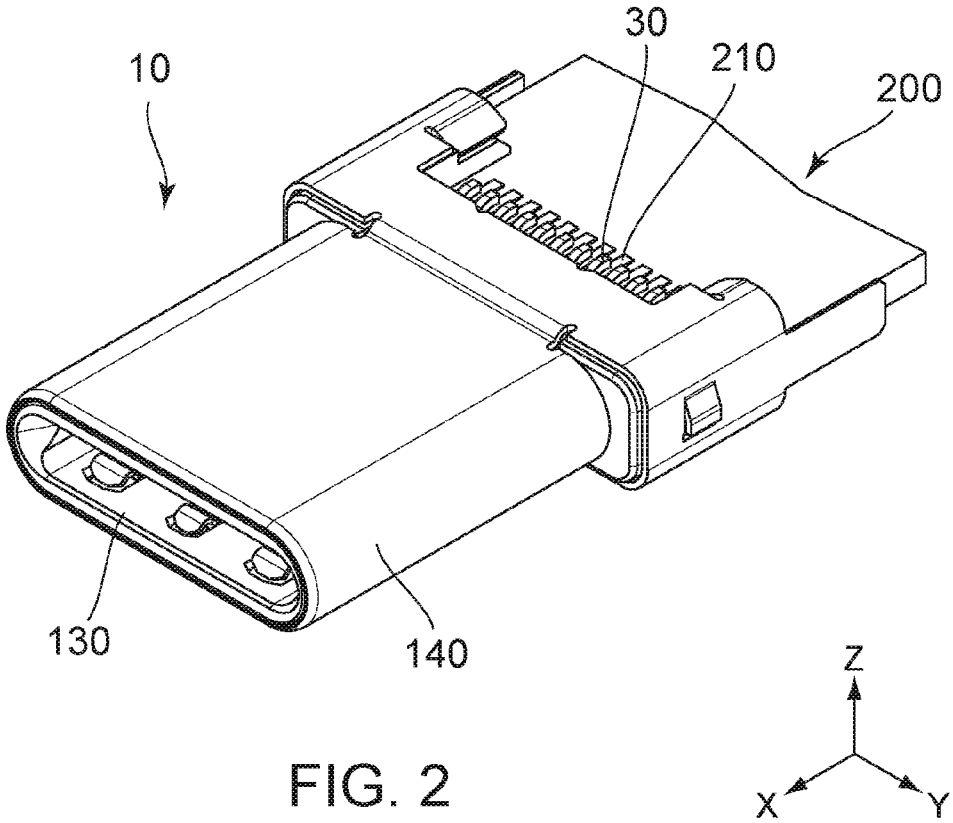
FIG. 2 is a perspective view showing the connector of FIG. 1.
Figure 3:
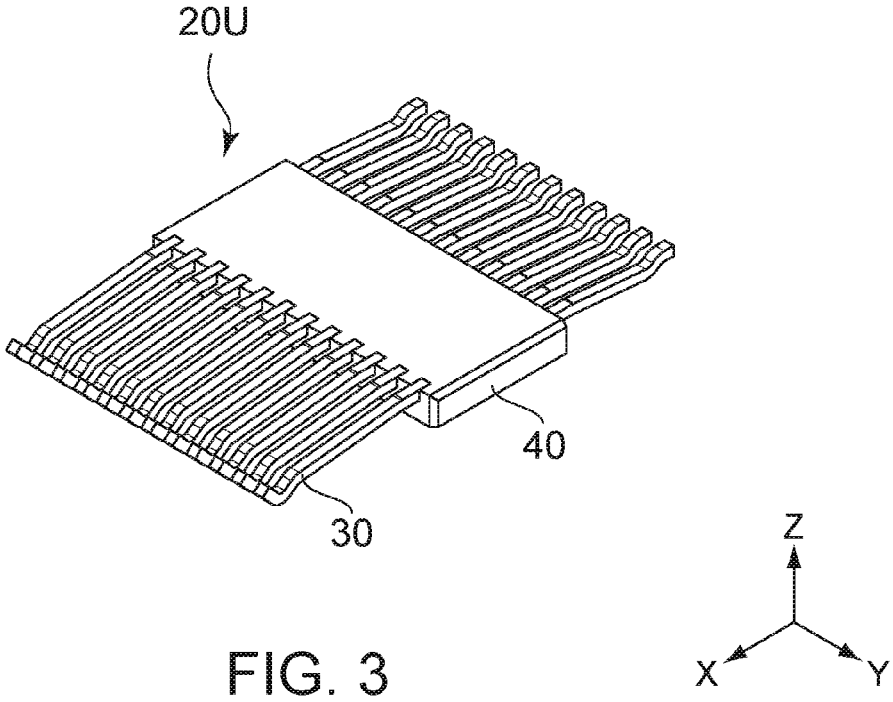
FIG. 3 is a top, perspective view showing a contact member which is included in the connector of FIG. 1 and which is positioned at an upper part thereof. The illustrated contact member is not yet attached to a ground member.

Referring to FIGS. 1 and 2, a connector 10 according to an embodiment of the present invention is mateable with a mating connector (not shown) along a front-rear direction (X-direction). The mating connector (not shown) has mating lock portions (not shown). As shown in FIG. 1, the connector 10 of the present embodiment comprises two contact members 20U, 20L, a ground member 80, a holding member 130, a shell 140 and two accessory members 150. The ground member 80 is made of metal. The holding member 130 is made of insulator. The shell 140 is made of metal. Each of the accessory members 150 is made of metal. As understood from FIGS. 1 and 2, the holding member 130 holds the contact members 20U, 20L and the ground member 80 together. The shell 140 partially covers the holding member 130. Each of the accessory members 150 is accommodated between the holding member 130 and the shell 140. Each of the accessory members 150 is connected with the shell 140.

As understood from FIGS. 1 and 11 to 13, the two contact members 20U, 20L have structures same as each other. Hereafter, explanation is mainly made about the contact member 20U, which is positioned at an upper part of the connector 10, with reference to drawings. Detail explanation about the contact member 20L, which is positioned at a lower part of the connector 10, will be omitted except for a matter to which special attention needs to be paid.

As shown in FIGS. 3 to 6, the contact member 20U comprises a plurality of contacts 30 and an arrangement member 40. Each of the contacts 30 is made of conductor. The arrangement member 40 is made of insulator. The arrangement member 40 arranges the contacts 30 in a pitch direction (lateral direction: Y-direction) and holds the contacts 30. The contacts 30 according to the present embodiment are partially embedded into the arrangement member 40 via insert-molding when the arrangement member 40 is molded. However, the present invention is not limited thereto. The contacts 30 may be press-fit into the arrangement member 40.

As understood from FIGS. 1 and 2, rear sides (negative X-sides) of the contacts 30 are connected with pads 210, respectively, of the paddle card 200.

Figure 4:
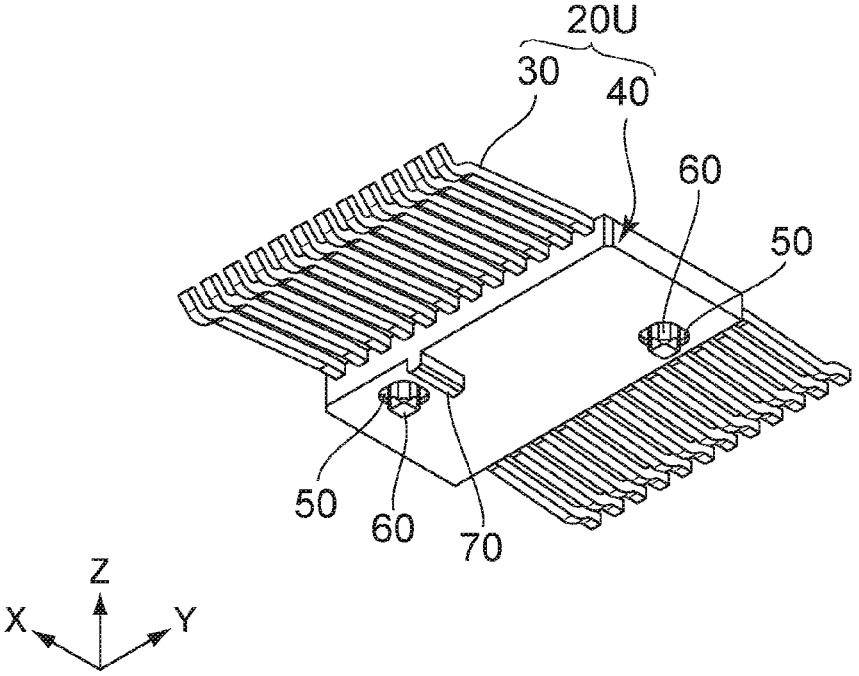
FIG. 4 is a bottom, perspective view showing the contact member of FIG. 3.
Figure 5:
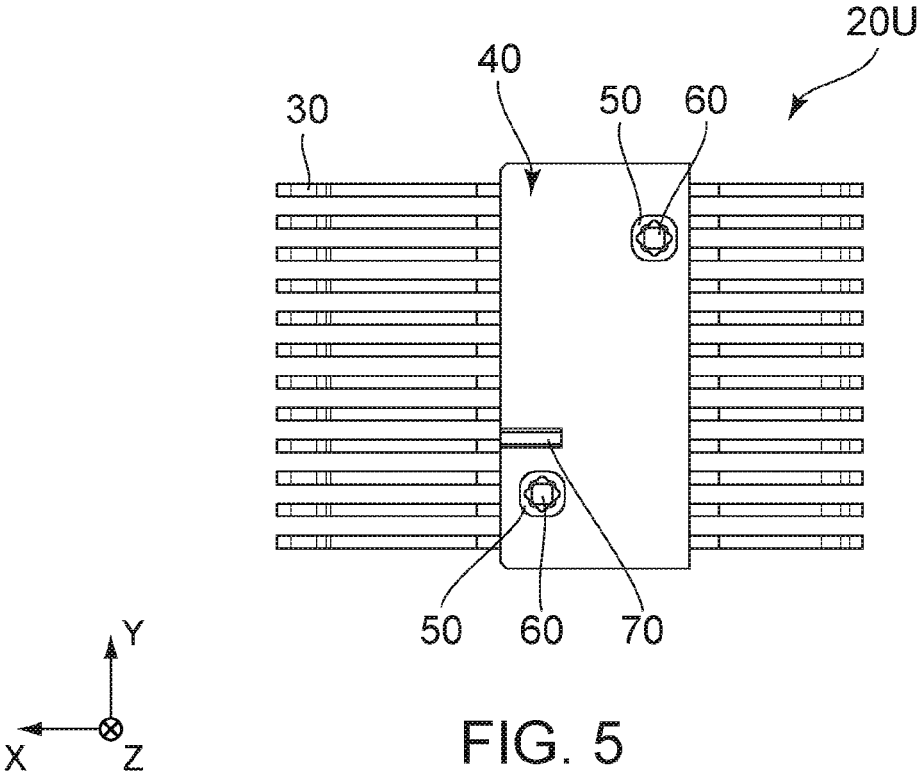
FIG. 5 is a bottom view showing the contact member of FIG. 3.

As shown in FIGS. 4 and 5, the arrangement member 40 is provided with two recesses 50, two press-fit protrusions 60 and an island-like protrusion 70. The recesses 50 correspond to the press-fit protrusions 60, respectively.

Figure 7:
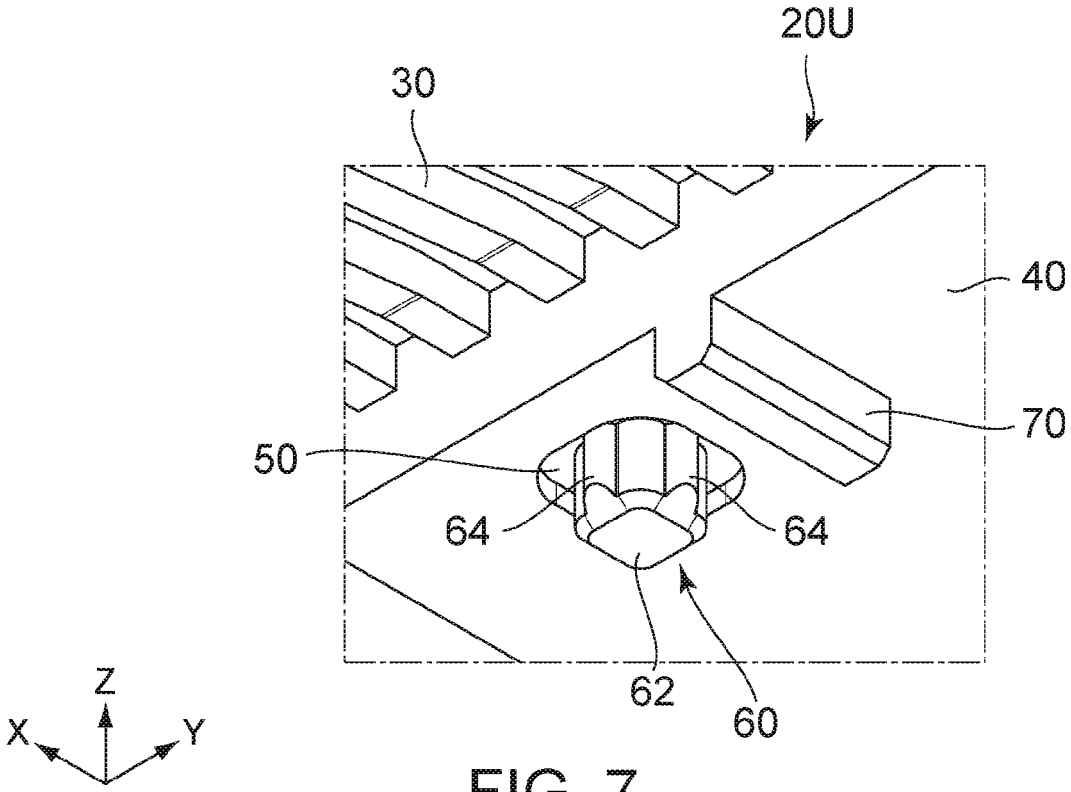
FIG. 7 is an enlarged view showing a part of the contact member of FIG. 4.

As best shown in FIG. 7, each of the press-fit protrusions 60 protrudes in a protruding direction (downward direction: negative Z-direction) from an inside of the corresponding recess 50, and each of the recesses 50 is recessed in a direction (upward direction: positive Z-direction) opposite to the protruding direction. As described above, the protruding direction of each of the press-fit protrusions 60 of the contact member 20U positioned at the upper part thereof is the downward direction (negative Z-direction), and a direction, in which each of the recesses 50 of the contact member 20U positioned at the upper part thereof is recessed, is the upward direction (positive Z-direction). In contrast, as understood from FIG. 1, a protruding direction of each of the press-fit protrusions 60 of the contact member 20L positioned at the lower part thereof is the upward direction, and a direction, in which each of the recesses 50 of the contact member 20L positioned at the lower part thereof is recessed, is the downward direction.

Figure 8:
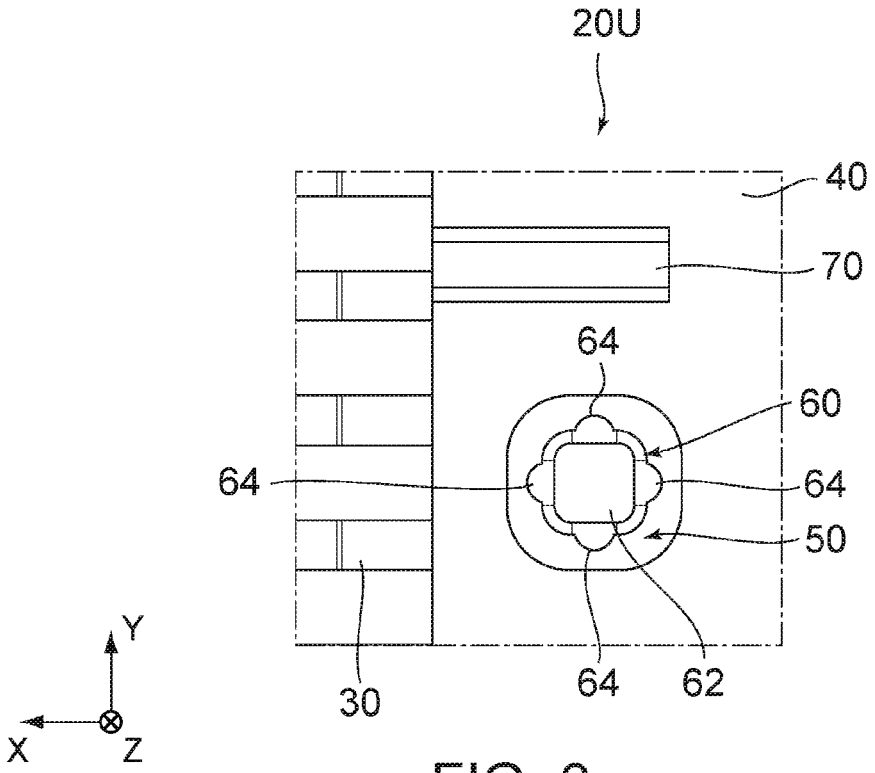
FIG. 8 is an enlarged view showing a part of the contact member of FIG. 5.
Figure 9:
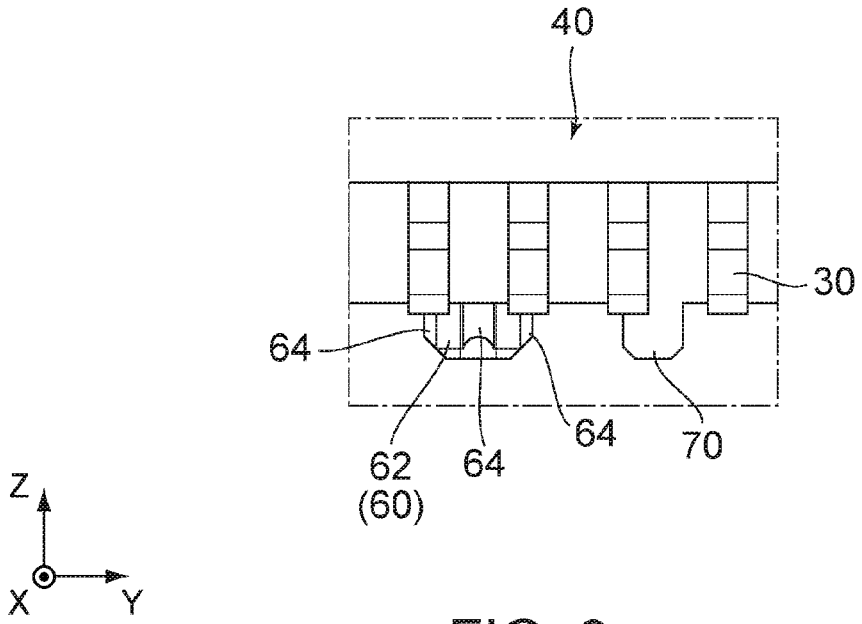
FIG. 9 is an enlarged view showing a part of the contact member of FIG. 6.

As shown in FIGS. 7 to 9, each of the press-fit protrusions 60 has a main protrusion portion 62 and a plurality of sub protrusion portions 64. The main protrusion portion 62 protrudes in the protruding direction. Each of the sub protrusion portions 64 protrudes from the main protrusion portion 62 in a direction perpendicular to the protruding direction while extending in the protruding direction. Specifically, the sub protrusion portions 64 radially extend from the main protrusion portion 62 in a horizontal plane (XY-plane) perpendicular to the protruding direction. As best shown in FIG. 8, in the present embodiment, the number of the sub protrusion portions 64 is four, and the sub protrusion portions 64 are arranged at regular intervals in the horizontal plane. In detail, as shown in FIG. 8, the main protrusion portion 62 has a rounded square shape in the horizontal plane. In the horizontal plane, the sub protrusion portions 64 protrude outward from sides of the main protrusion portion 62 to have circular arc-like shapes, respectively. As shown in FIGS. 7 and 9, each of the press-fit protrusions 60 of the present embodiment is tapered at an end thereof in the protruding direction.

Figure 6:
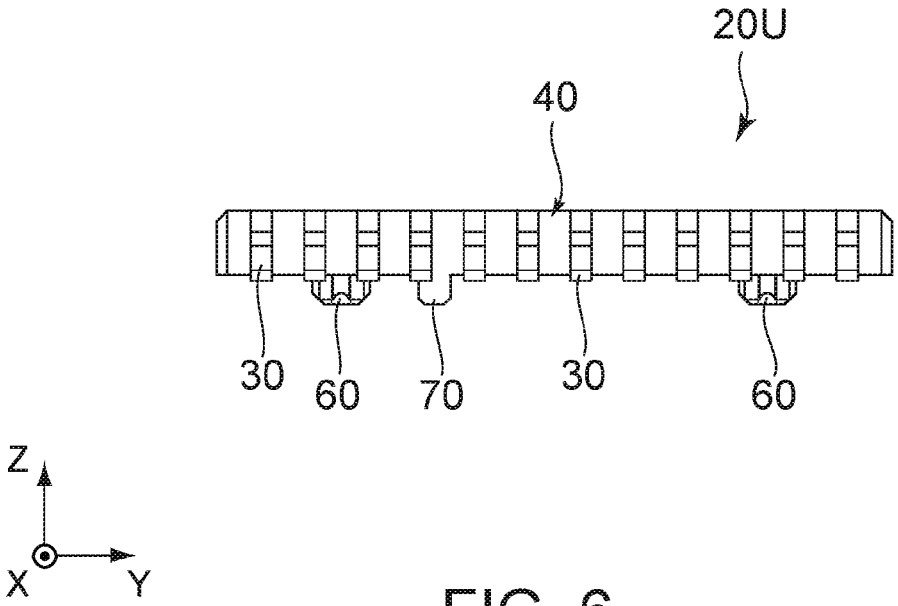
FIG. 6 is a front view showing the contact member of FIG. 3.

As shown in FIGS. 4, 5, 7 and 8, the island-like protrusion 70 protrudes in the protruding direction while extending long in a predetermined direction perpendicular to the protruding direction. Although the predetermined direction of the present embodiment is the front-rear direction (X-direction), the present invention is not limited thereto. For example, the predetermined direction may be the pitch direction. As best shown in FIG. 8, the island-like protrusion 70 has a first size in the predetermine direction, each of the press-fit protrusions 60 has a second size in the predetermined direction, and the first size is larger than the second size. Meanwhile, as shown in FIGS. 6 and 9, a size of the island-like protrusion 70 in the protruding direction is same as a size of each of the press-fit protrusions 60 in the protruding direction. As shown in FIGS. 7 and 9, the island-like protrusion 70 of the present embodiment is tapered at an end thereof in the protruding direction.

Figure 10:
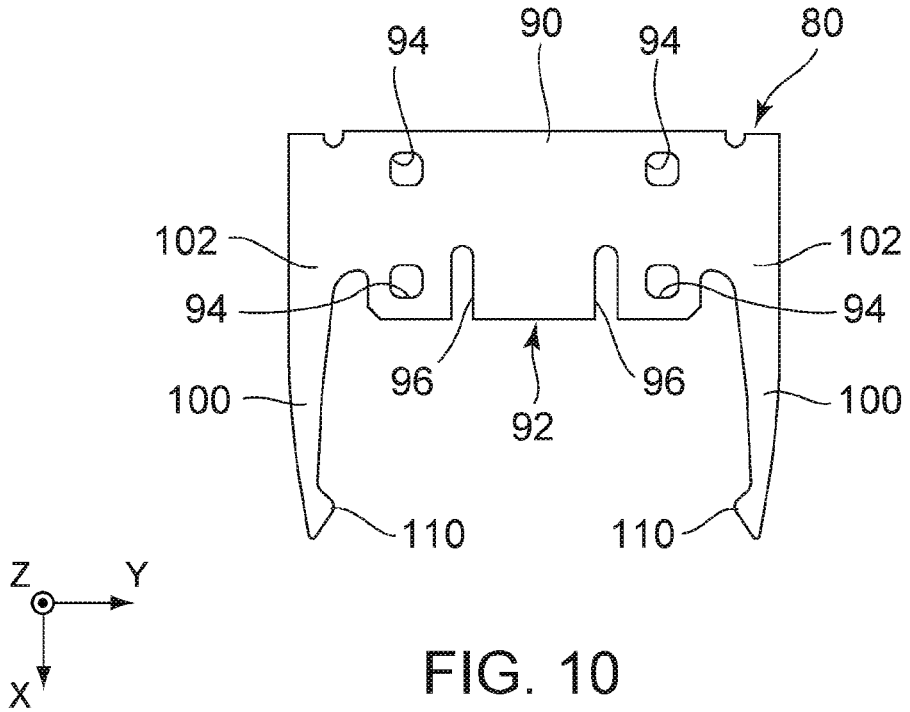
FIG. 10 is a top view showing the ground member which is included in the connector of FIG. 1.

As shown in FIG. 10, the ground member 80 has a plate-like main portion 90, lock springs 100 and lock portions 110. Each of the lock springs 100 is resiliently deformable. The lock portions 110 lock the mating lock portions (not shown), respectively. The lock portions 110 are supported by the lock springs 100, respectively.

The main portion 90 of the ground member 80 is formed with four holes 94 and two protrusion accommodation portions 96. The two protrusion accommodation portions 96 are equally distant from an axis which passes through a center of the ground member 80 in the pitch direction while extending in the front-rear direction. The four holes 94 are arranged in a square form, and each two of the holes 94 which are positioned on opposite corners of the square form are paired with each other. As understood from above, the holes 94 of one of the pairs and the holes 94 of a remaining one of the pairs are arranged to be axisymmetrical with each other about the axis which passes through the center of the ground member 80 in the pitch direction while extending in the front-rear direction. Moreover, each of the holes 94, which are positioned at a front part (a part in a positive X-direction) of the main portion 90, and its adjacent protrusion accommodation portion 96 form one set. In other words, the main portion 90 of the ground member 80 is formed with two sets each consisting of two of the holes 94 and the single protrusion accommodation portion 96. The holes 94 and the protrusion accommodation portion 96 of each set correspond to one of the contact member 20U, which is positioned at the upper part thereof, and the contact member 20L which is positioned at the lower part thereof.

Figure 14:
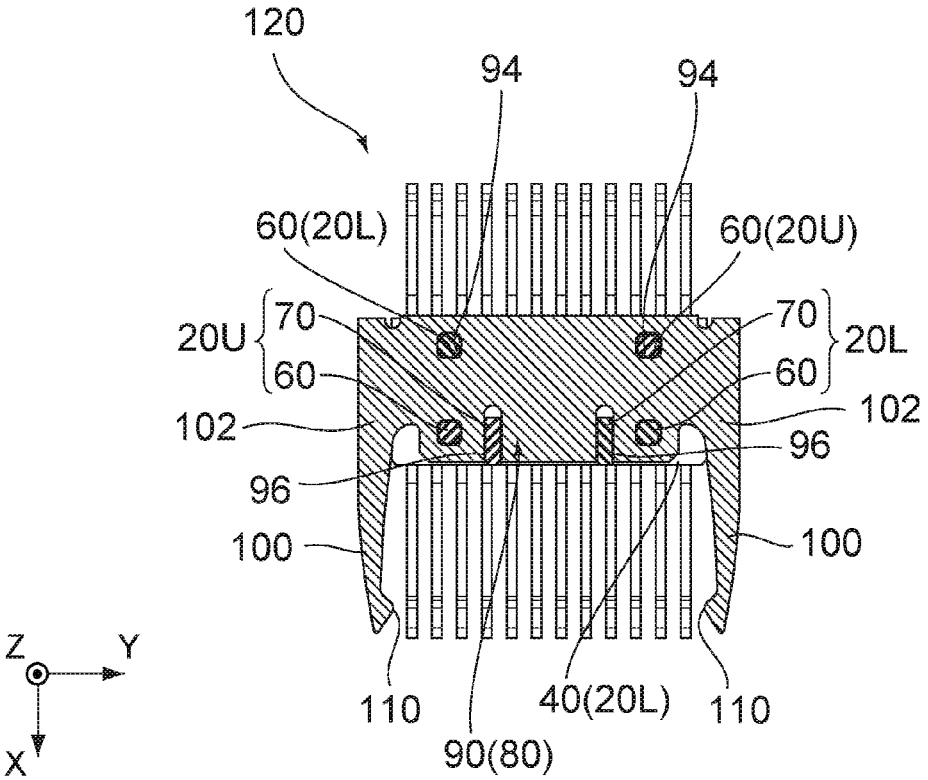
FIG. 14 is a cross-sectional view showing the structure of FIG. 12, taken along line XIV-XIV.

As understood from FIGS. 10 and 14, the holes 94 correspond to the press-fit protrusions 60, respectively, and the protrusion accommodation portions 96 correspond to the island-like protrusions 70, respectively. As shown in FIG. 14, each of the press-fit protrusions 60 is press-fit into the corresponding hole 94, and each of the island-like protrusions 70 is accommodated in the corresponding protrusion accommodation portion 96. In the present embodiment, the ends of the press-fit protrusions 60 and the island-like protrusion 70 are tapered. Accordingly, it is easy to press-fit the press-fit protrusion 60 into the corresponding hole 94, and it is easy to accommodate the island-like protrusion 70 in the corresponding protrusion accommodation portion 96.

The holes 94 and the protrusion accommodation portions 96 are arranged to be axisymmetrical about the axis which passes through the center of the ground member 80 in the pitch direction while extending in the front-rear direction. Accordingly, the contact members 20U, 20L can have structures same as each other. Specifically, it is not necessary that the arrangement of the press-fit protrusions 60 and the island-like protrusion 70 of contact member 20U is different from that of the contact member 20L. In addition, since the holes 94 and the protrusion accommodation portions 96 have the aforementioned arrangement, a structure 120, which is obtained by combining the contact members 20U, 20L with the ground member 80, has symmetry in both an up-down direction and the lateral direction as shown in FIGS. 12 and 13.

Figure 12:
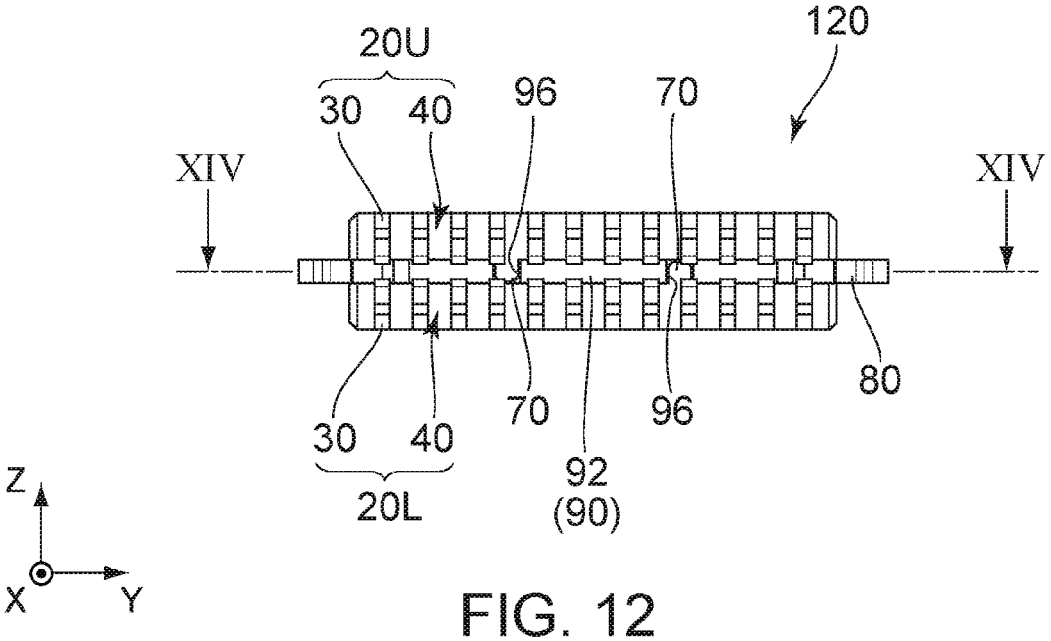
FIG. 12 is a front view showing the structure of FIG. 11.
Figure 13:
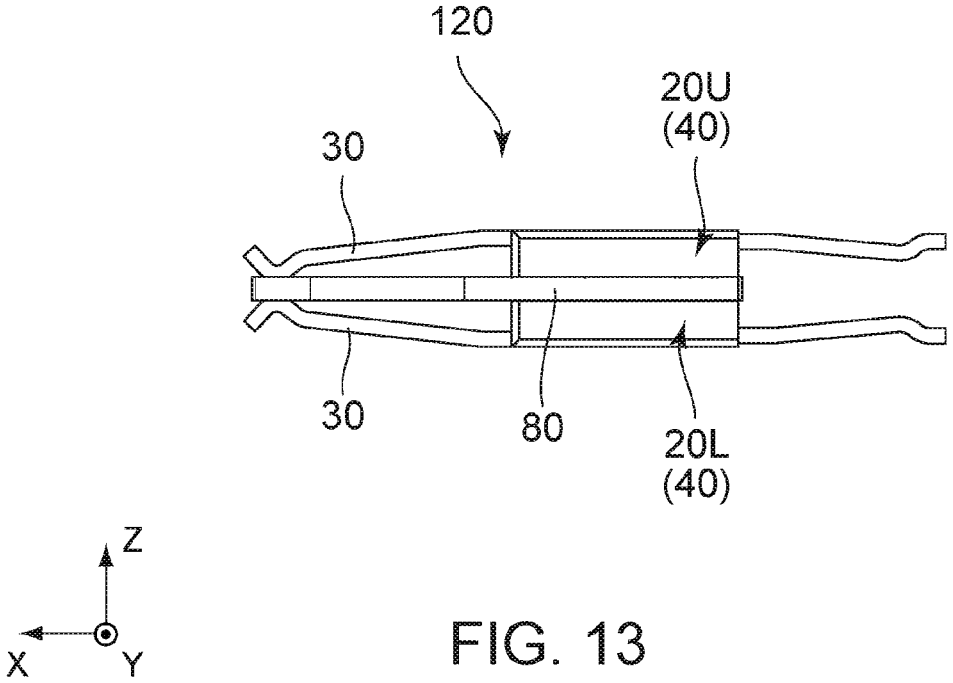
FIG. 13 is a side view showing the structure of FIG. 11.

As understood from FIGS. 6, 9 and 12, a thickness of the main portion 90 of the ground member 80 (a size thereof in the Z-direction) is almost same as each of heights of the press-fit protrusions 60 and the island-like protrusions 70 (protruding amounts thereof in the Z-direction). Manufacture tolerances of the arrangement member 40 and the ground member 80 need to be considered. Accordingly, the thickness of the main portion 90 of the ground member 80 is, properly speaking, designed to be greater than each of the heights of the press-fit protrusions 60 and the island-like protrusions 70. Accordingly, in the present embodiment, the press-fit protrusions 60 and the island-like protrusion 70 of the contact member 20U positioned at the upper part thereof never abut against the arrangement member 40 of the contact member 20L positioned at the lower part thereof. Similarly, in the present embodiment, the press-fit protrusions 60 and the island-like protrusion 70 of the contact member 20L positioned at the lower part thereof never abut against the arrangement member 40 of the contact member 20U positioned at the upper part thereof.

Figure 15:
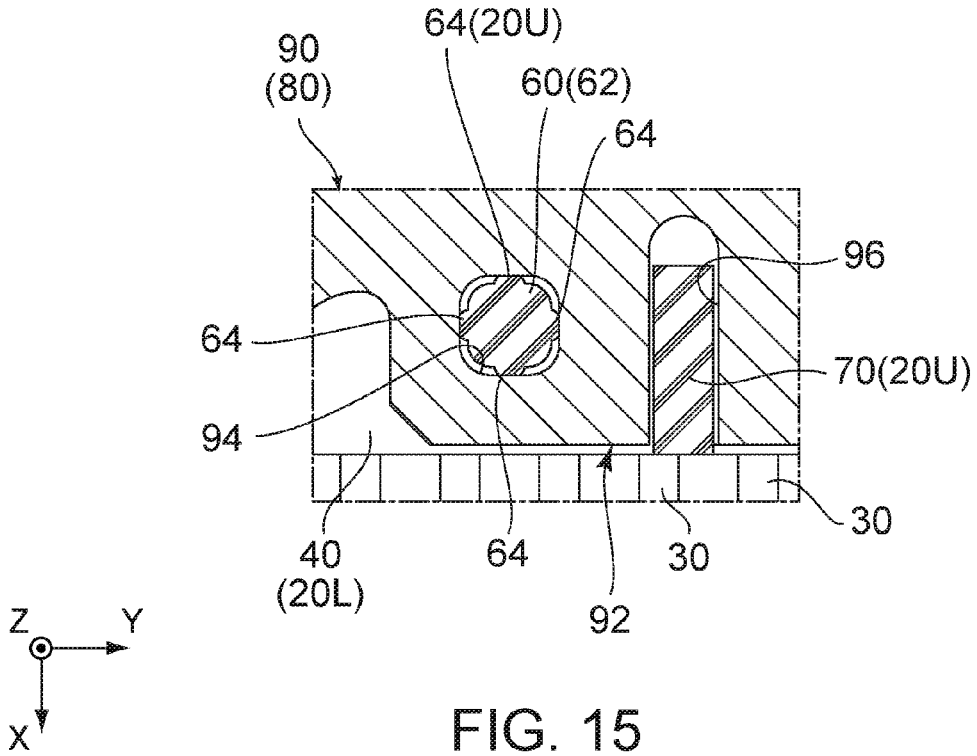
FIG. 15 is an enlarged view showing a part of the structure of FIG. 14.
Figure 16:
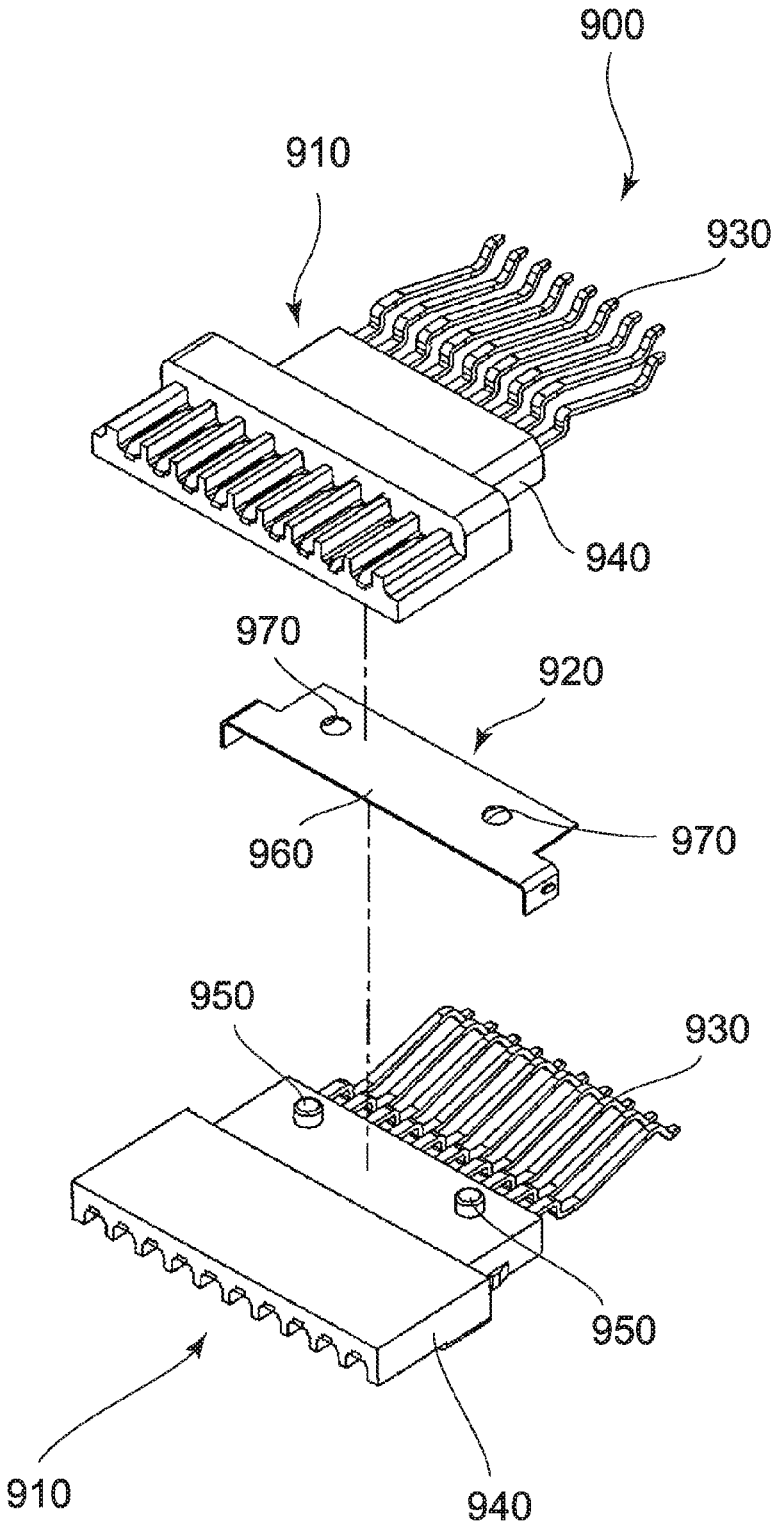
FIG. 16 PRIOR ART
FIG. 16 is an exploded, perspective view showing a connector of Patent Document 1.

Explanation is made further in detail about shapes of the holes 94 and the protrusion accommodation portions 96. As shown in FIG. 15, each of the holes 94 has a rounded square shape. As understood from FIG. 15, each of the holes 94 is larger than the main protrusion portion 62 of the corresponding press-fit protrusion 60 in the horizontal plane. In other words, each of the main protrusion portions 62 is smaller than the corresponding hole 94 of the main portion 90 of the ground member 80 in the horizontal plane. Accordingly, when the press-fit protrusion 60 is press-fit into the corresponding hole 94, a whole of the main protrusion portion 62 is received in the corresponding hole 94. However, each of the sub protrusion portions 64 of the press-fit protrusion 60 protrudes outward from an edge of the corresponding hole 94. Thus, when the press-fit protrusion 60 is press-fit into the corresponding hole 94, the sub protrusion portions 64 are partially shaved so that the ground member 80 can be fixed to the arrangement member 40 without any play as understood from FIGS. 8 and 15. In addition, the shavings, which are produced when each of the press-fit protrusions 60 is press-fit into the corresponding hole 94, are received in the corresponding recess 50.

As shown in FIG. 15, in the horizontal plane, each of the protrusion accommodation portions 96 has an elongated, slit-like shape which reaches an front edge (end portion) 92 of the main portion 90 of the ground member 80. In other words, each of the protrusion accommodation portions 96 is opened at the front edge 92 of the main portion 90. An innermost part of each of the protrusion accommodation portions 96 in the front-rear direction has a circular arc-like shape. Each of the protrusion accommodation portions 96 has a constant width from the innermost part to the front edge 92 of the main portion 90. The width (a size in the Y-direction) of the protrusion accommodation portion 96 is slightly larger than a size of the corresponding island-like protrusion 70 in the pitch direction. Accordingly, the island-like protrusion 70 of the present embodiment is accommodated in the corresponding protrusion accommodation portion 96 without being shaved thereby. Specifically, the island-like protrusion 70 of the present embodiment is not press-fit into the corresponding protrusion accommodation portion 96.

As shown in FIG. 10, a distance between a base 102 of the lock spring 100 and the hole 94 is shorter than another distance between the base 102 and the protrusion accommodation portion 96. In other words, as shown in FIG. 14, the press-fit protrusion 60 is positioned away from the base 102 of the lock spring 100 by a first distance, the island-like protrusion 70 is positioned away from the base 102 by a second distance, and the first distance is shorter than the second distance. Since the slit-like protrusion accommodation portion 96 is positioned away from the lock spring 100, a strength of the ground member 80 can be secured.

Figure 11:
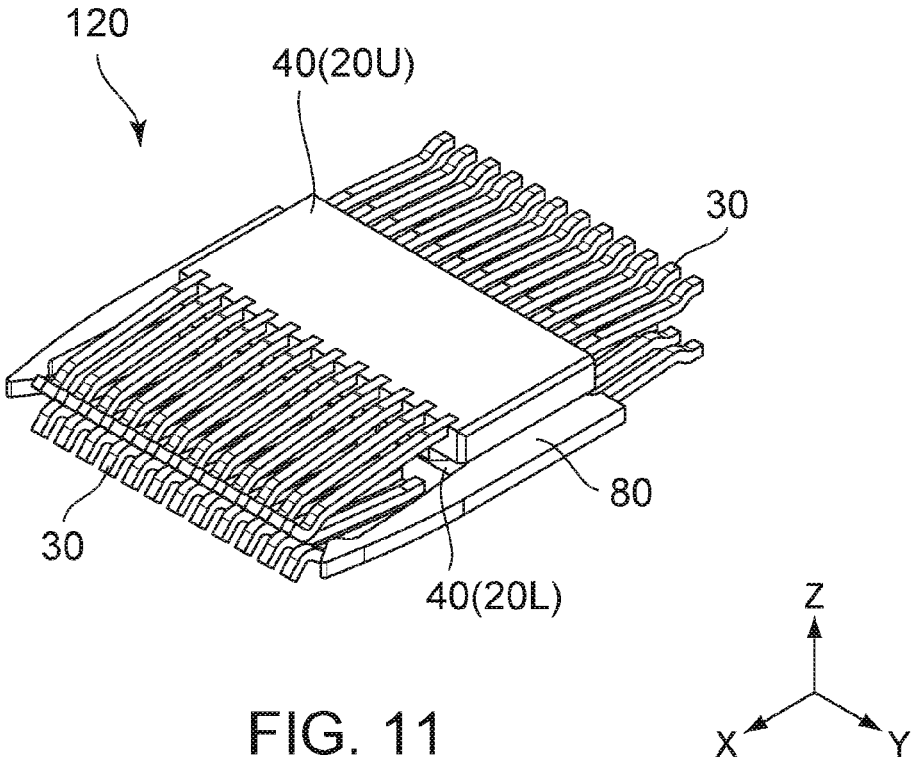
FIG. 11 is a perspective view showing a structure combined of the contact member, which is positioned at the upper part thereof, a contact member, which is positioned at a lower part thereof, and the ground member, wherein the contact members and the ground member are included in the connector of FIG. 1.

As shown in FIG. 14, each of the press-fit protrusions 60 is press-fit into the corresponding hole 94 while each of the island-like protrusions 70 is accommodated in the corresponding protrusion accommodation portion 96. Then, as shown in FIGS. 11 to 13, the contact member 20U positioned at the upper part thereof, the contact member 20L positioned at the lower part thereof and the ground member 80 are integrally combined to form the structure 120. As understood from FIGS. 8 and 15, in the present embodiment, the number of the sub protrusion portions 64 is four, and the sub protrusion portions 64 are arranged at the regular intervals in the horizontal plane. Accordingly, in a process where the press-fit protrusion 60 is press-fit into the corresponding hole 94, a center of the main protrusion portion 62 can be relatively aligned with a center of the corresponding hole 94 in the horizontal plane. In a case where the sub protrusion portion 64 is partially shaved when the press-fit protrusion 60 is press-fit into the corresponding hole 94, a rotational deviation might occur in a positional relation between the ground member 80 and the arrangement member 40 in the horizontal plane. However, since the island-like protrusion 70 is accommodated in the corresponding protrusion accommodation portion 96, the aforementioned rotational deviation can be prevented from occurring therein.

As expected from FIGS. 1 and 2, the thus-configured structure 120 is inserted from a rear side (negative X-side) of the holding member 130 to be held by the holding member 130. Specifically, the contact members 20U, 20L and the ground member 80 are together held by the holding member 130.

While the present invention has been described with specific embodiments, the present invention is not limited thereto but may be modified in various manners.

Although the protrusion accommodation portion 96 of the aforementioned embodiment reaches the front edge 92 of the main portion 90 of the ground member 80, the protrusion accommodation portion 96 may not reach the front edge 92. Specifically, the protrusion accommodation portion 96 may be a through hole which is not opened at the front edge 92 (i.e. is closed thereat).

Although the connector 10 of the aforementioned embodiment comprises the two contact members 20U, 20L, the connector 10 may comprises only one of the two contact members 20U, 20L. In a case where the connector 10 comprises one of the two contact members 20U, 20L, it is sufficient that the main portion 90 of the ground member 80 is formed with one set of the holes 94 and the protrusion accommodation portion 96.

In the aforementioned embodiment, the holes 94 and the protrusion accommodation portions 96, which are formed at the main portion 90 of the ground member 80, are arranged to be axisymmetrical about the axis which passes through the center of the ground member 80 in the pitch direction while extending in the front-rear direction. If the contact members 20U, 20L have structures same as each other, the aforementioned arrangement enables the structure 120, which is formed by combining the contact members 20U, 20L and the ground member 80, to have symmetry in both the up-down direction and the lateral direction. In a case where the structure 120 does not need to have symmetry in both the up-down direction and the lateral direction, the holes 94 and the protrusion accommodation portions 96 may not be arranged to be axisymmetrical thereabout.

The present application is based on a Japanese patent application of JP2014-115220 filed before the Japan Patent Office on Jun. 3, 2014, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10 connector
20U, 20L contact member
30 contact
40 arrangement member
50 recess
60 press-fit protrusion
62 main protrusion portion
64 sub protrusion portion
70 island-like protrusion
80 ground member
90 main portion
92 front edge (end portion)
94 hole
96 protrusion accommodation portion
100 lock spring
102 base
110 lock portion
120 structure
130 holding member
140 shell
150 accessory member
200 paddle card
210 pad
900 connector
910 contact member
920 ground member
930 contact
940 arrangement member
950 protrusion
960 main portion
970 hole

The invention claimed is:

1. A connector mateable with a mating connector along a front-rear direction, wherein:

the connector comprises a contact member and a ground member;

the contact member comprises a plurality of contacts and an arrangement member;

the arrangement member arranges the contacts in a pitch direction perpendicular to the front-rear direction and holds the contacts;

the arrangement member is provided with two press-fit protrusions and an island-like protrusion;

each of the press-fit protrusions protrudes in a protruding direction perpendicular to both the front-rear direction and the pitch direction;

the island-like protrusion protrudes in the protruding direction and extends long in a predetermined direction perpendicular to the protruding direction;

the island-like protrusion has a first size in the predetermine direction;

each of the press-fit protrusions has a second size in the predetermined direction;

the first size is larger than the second size;

the ground member has a plate-like main portion;

the main portion of the ground member is formed with two holes and a protrusion accommodation portion; and the press-fit protrusions are press-fit into the holes, respectively, while the island-like protrusion is accommodated in the protrusion accommodation portion.

2. The connector as recited in claim 1, wherein:

the mating connector has a mating lock portion;

the ground member has a lock portion and a lock spring;

the lock portion locks the mating lock portion;

the lock spring supports the lock portion;

the press-fit protrusion is positioned away from a base of the lock spring by a first distance;

the island-like protrusion is positioned away from the base by a second distance; and the first distance is shorter than the second distance.

3. The connector as recited in claim 1, wherein:

the main portion has an end in the front-rear direction; and the protrusion accommodation portion reaches the end of the main portion of the ground member in a plane perpendicular to the protruding direction.

4. The connector as recited in claim 1, wherein:

the connector comprising two of the contact members;

the two contact members have structures same as each other;

the main portion of the ground member is formed with two sets each consisting of the two holes and the protrusion accommodation portion; and the two holes of one of the two sets and the two holes of a remaining one of the two sets are arranged to be axisymmetrical with each other about an axis which passes through a center of the ground member in the pitch direction while extending in the front-rear direction.

5. The connector as recited in claim 1, wherein:

each of the press-fit protrusions has a main protrusion portion and a plurality of sub protrusion portions;

the main protrusion portion extends in the protruding direction;

the main protrusion portion is smaller than the corresponding hole of the main portion of the ground member in a plan perpendicular to the protruding direction; and each of the sub protrusion portions protrudes from the main protrusion portion in a direction perpendicular to the protruding direction while extending in the protruding direction.

6. The connector as recited in claim 1, wherein:

the arrangement member is formed with two recesses;

the recesses correspond to the press-fit protrusions, respectively;

each of the recesses is recessed in a direction opposite to the protruding direction; and each of the press-fit protrusions protrudes from an inside of the corresponding recess in the protruding direction.

7. The connector as recited in claim 1, further comprising a holding member which holds the contact member(s) and the ground member together.

* * * * *